US008596344B2

(12) United States Patent
Lutzhöft et al.

(10) Patent No.: US 8,596,344 B2
(45) Date of Patent: Dec. 3, 2013

(54) HANDLING DEVICE FOR PIPES

(75) Inventors: Jens Lutzhöft, Hamburg (DE); Jörn Grotherr, Hamburg (DE); Tomoya Inoue, Kanagawa-ken (JP); Eiichi Higashi, Nagasaki-ken (JP)

(73) Assignee: Blohm + Voss Oil Tools GmbH, Hamburg (DE)

( * ) Notice: Subject to any disclaimer, the term of this patent is extended or adjusted under 35 U.S.C. 154(b) by 371 days.

(21) Appl. No.: 12/863,002

(22) PCT Filed: Jan. 16, 2009

(86) PCT No.: PCT/DE2009/000097

§ 371 (c)(1),
(2), (4) Date: Feb. 2, 2011

(87) PCT Pub. No.: WO2009/089832

PCT Pub. Date: Jul. 23, 2009

(65) Prior Publication Data

US 2011/0146969 A1 Jun. 23, 2011

(30) Foreign Application Priority Data

Jan. 16, 2008 (DE) ..... 10 2008 005 135

(51) Int. Cl.
*E21B 19/10* (2006.01)

(52) U.S. Cl.
USPC ..... 166/77.51; 166/85.1

(58) Field of Classification Search
USPC ..... 166/380, 77.51, 85.1, 78.1
See application file for complete search history.

(56) References Cited

U.S. PATENT DOCUMENTS

| | | | | |
|---|---|---|---|---|
| 2,654,155 | A * | 10/1953 | Barnhart | 33/760 |
| 4,421,447 | A | 12/1983 | Gudgel et al. | |
| 4,582,133 | A * | 4/1986 | Tambs | 166/77.51 |
| 7,114,235 | B2 * | 10/2006 | Jansch et al. | 29/464 |
| 7,206,717 | B2 | 4/2007 | Hardy | |
| 7,296,630 | B2 | 11/2007 | Severin et al. | |
| 7,314,090 | B2 * | 1/2008 | Thomas et al. | 166/380 |
| 2002/0189804 | A1 | 12/2002 | Liess et al. | |
| 2004/0216924 | A1 | 11/2004 | Pietras et al. | |
| 2006/0191689 | A1 | 8/2006 | Severin et al. | |
| 2011/0079584 | A1 * | 4/2011 | Hees | 219/61 |

FOREIGN PATENT DOCUMENTS

WO 2005028808 3/2005

* cited by examiner

*Primary Examiner* — William P Neuder
(74) *Attorney, Agent, or Firm* — Lucas & Mercanti, LLP; Klaus P. Stoffel

(57) ABSTRACT

The handling apparatus is used for positioning and holding of drill pipes. At least, a handling apparatus for the drill pipes is so arranged that it can be positioned both horizontally and vertically and it is equipped with a controllable clamping apparatus for the drill pipes. In the vicinity of the holding apparatus, a centering apparatus is arranged for the drill pipe to be held.

14 Claims, 4 Drawing Sheets

HANDLING DEVICE FOR PIPES

Figure 1:
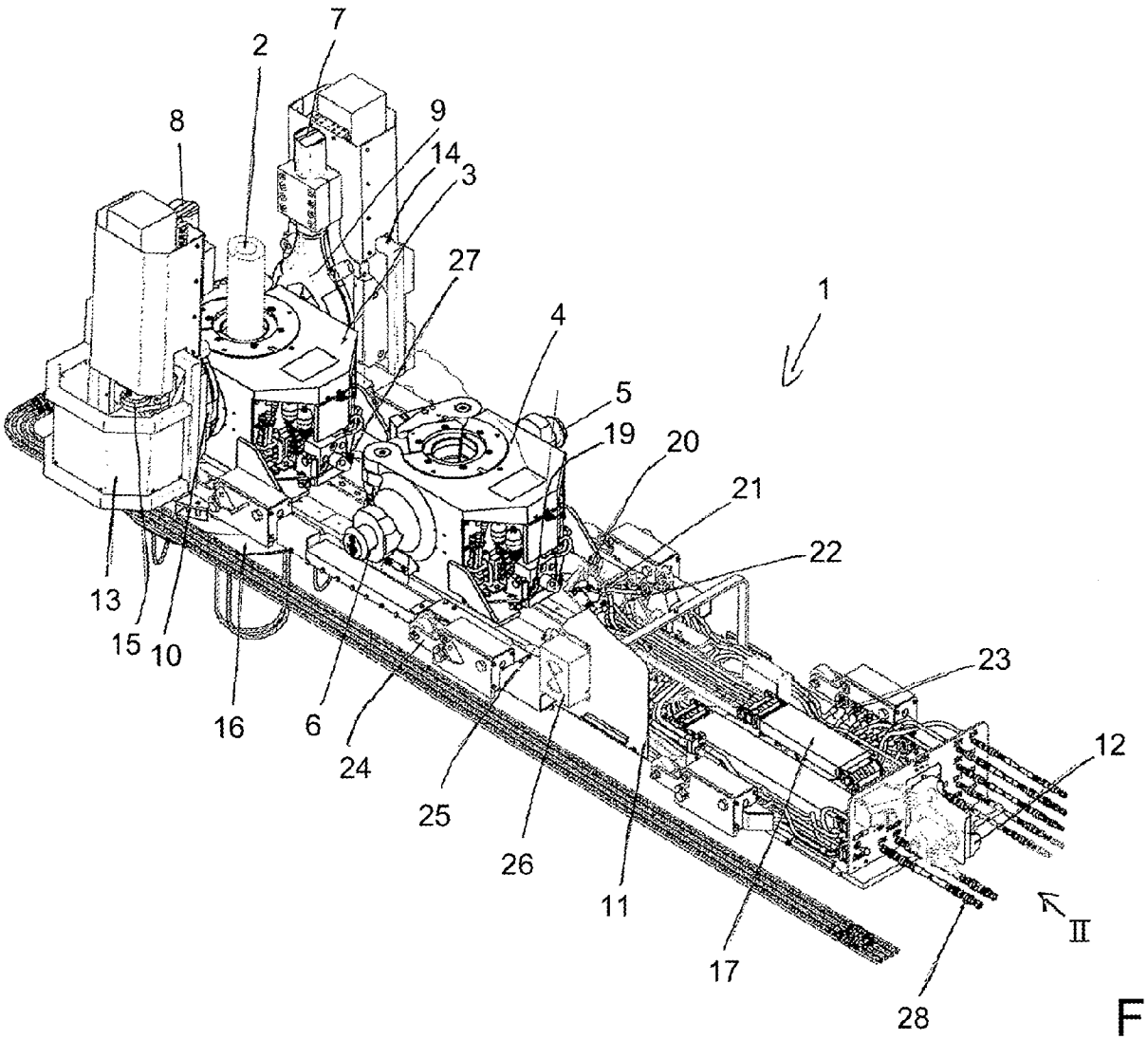

The present application is a 371 of PCT/DE2009/000097 filed Jan. 16, 2009 which claims priority from DE 10 2008 005 135.7 filed Jan. 16, 2008, the contents of both are incorporated herein by reference.

The invention relates to a handling apparatus for pipes, by which a holding apparatus is provided to enable positioning both in horizontal and vertical directions and is equipped with a controllable clamping apparatus for the pipes.

This type of handling apparatus is described in U.S. Pat. No. 7,206,717. Further details on the corresponding handling apparatus are explained in the U.S. Pat. No. 7,296,630.

This type of handling apparatus is in particular used to position the pipe in drilling apparatuses, within which the drilling tool is handled and through which the product to be extracted finally passes, for exploration or extraction of petroleum or natural gas during the drilling process. The previously known handling apparatuses cannot yet fulfill all requirements set within the framework of the multifaceted application requirements.

Therefore, the purpose of the invention concerned is to improve a handling apparatus of the above-mentioned type, so that an improved utilization quality is provided during handling and positioning of the pipe.

This purpose is achieved in accordance with invention, by providing a centering apparatus for the pipe to be held in the vicinity of the holding apparatus.

Under application of the centering system, the pipe is so centered relatively with a drilling hole that the longitudinal axis of the pipe always passes through the center of the drilling hole. In addition to the centering of the pipe, the centering system also carries out a lateral stabilization of the positioning of the drill pipe, so that, in particular, the utilization of self-closing handling apparatuses is supported, which are transported after a lateral sliding onto the drill pipe through mechanical contact with the drill pipe automatically into a closed location.

Larger controlling torques can be used because the centering apparatus is hydraulically configured.

An appropriate arrangement is provided by holding the centering apparatus with a rotary table.

Lowering or lifting of piping that is assembled from multiple single pipes is supported by arranging two holding apparatuses on a sledge in direction of a longitudinal axis of sledge, one after the other.

To support a lateral sliding onto the drill pipe, it is proposed that, at least, one of the holding apparatuses is equipped with a lateral door.

A reliable and robust centering function can be provided by providing the centering apparatus with guide plates.

To facilitate maintenance work, it is taken into consideration that the centering apparatus with swingable flaps is equipped as centering elements.

A possible accident risk can be reduced because the flaps can be locked in a high-swung location.

An appropriate configuration form is provided because the centering apparatus has a divided outer ring.

For the position detection, it is proposed that a proximity switch is used for one of the holding apparatuses, at least.

An exact positioning is ensured because an elevator moving cylinder is equipped with a position measuring system.

Large controlling torques can be provided because the elevator moving cylinder is equipped with a hydraulic drive.

A simple and, simultaneously, reliable and precise drive is carried out because the elevator moving cylinder is equipped with a proportional directional valve.

A locking state of the holding apparatus can be monitored, because, at least, one of the holding apparatuses is equipped with a pressure switch as indicating apparatus for a locking function.

To ensure a gentle movement of the hydraulic tubes, it is proposed that, for the mobile support of hydraulic tubes, an energy chain should be used.

In the drawings, configuration examples of the invention are illustrated. They are shown in the Figures below:

FIG. 1: A perspective view of the handling system.

Figure 2:
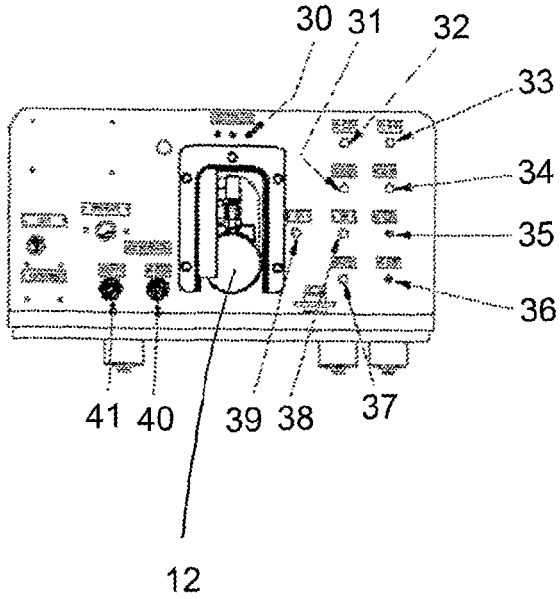

FIG. 2: A view according to line of sight II in FIG. 1 for the visualization of the position of the supply lines, FIG. 3: A view from the top of the centering apparatus, FIG. 4: A cross section according to intersecting line IV-IV in FIG. 3, FIG. 5: A side view of the centering apparatus, FIG. 6: Another representation of the centering apparatus, FIG. 7: A perspective representation of the centering apparatus with a folded-up segment of the centering apparatus.

FIG. 1 shows a perspective representation of a handling system (1) for the positioning of drill pipes (2). The handling system (1) has a first holding apparatus (3) as well as a second holding apparatus (4). According to the illustrated operation state, the first holding apparatus (3) receives the drill pipe (2) and the second holding apparatus (4) is positioned in the horizontal direction near the first holding apparatus (3).

The holding apparatuses (3, 4) have lateral and mutually-confronting-arranged bearing protrusions (5, 6), which are hit for a vertical positioning of the holding apparatuses (3, 4) of connection elements (7, 8), which have ring-shaped end segments (9, 10) for reception of the bearing protrusions (5, 6) and can be coupled with lifting apparatus that is not shown.

The holding apparatuses (3, 4) are so arranged on a sledge (11), in order to facilitate a horizontal positioning capability. A positioning is carried out by using an elevator moving cylinder (12), which is typically hydraulically configured.

FIG. 1 shows additionally a forward connection (13) as well as an after connection (14), a lateral multi-coupling (15) and a centering apparatus (16).

The hydraulic centering apparatus (16) is inserted in the drilling table directly below the sledge (11). The centering apparatus (16) work to center the drill pipe (2) in the middle of the drilling hole.

The centering is controlled depending upon the height-positioning of the holding apparatus (3)

A: When the drill pipe (2) is pulled out the holding apparatus (3) lifts the entire pipe line as an elevator and moves upwards. The drill pipe (2) is centered in the upper end position. Then the lower, empty holding apparatus (4) with open doors moves on the sledge (11) to the middle of the drill pipe. The elevator (4) hits the drill pipe (2) and thereby closes automatically. Without centering, the drill pipe (2) could spring away and the elevator (4) is not reliably closed.

B: When the drill pipe (2) is inserted, the elevator (3) with the pipe line is displaced. Shortly before placement, the drill pipe (2) is centered so that the elevator (3) is positioned exactly on the middle of the drill hole. The later coupling and uncoupling of the elevator (3) is thus simplified and ship movements are counterbalanced.

During operation, the centering apparatus sends an opening signal to the controller so that the operator is informed about the status.

The centering apparatus has interchangeable guide plates with which different areas of pipe diameters can be centered.

The centering apparatus can be opened for maintenance/lubrication, and in order to be able to perform a centering of larger pipe elements if necessary.

The opened covers are locked mechanically when they are opened for safety reasons, in order to prevent a risk of clamping.

An outer ring of the centering apparatus (16) is divided so that the centering apparatus (16) can be removed from the pine line if necessary.

An electric proximity switch is used for signaling the position of the elevator (3, 4) to the controller.

When the elevator (3, 4) is placed on the middle of the drill hole, an electric proximity switch sends a signal to the controller. The same goes for the rear park position.

A position measuring system of the elevator moving cylinder (12) and a hydraulic drive are used.

The elevator moving cylinder (12) is equipped with an electrical position measuring system. Thus, the current position of the elevator moving sledge (11) is always known and the controller also knows the position of the elevators (3, 4) in combination with the electric proximity switch.

The elevator moving cylinder (12) is controlled with a proportional directional valve. A higher operating speed is thereby possible together with the position measuring system, in particular, a higher elevator moving speed in combination with a slower start and stop.

An additional pressure switch is used to signal the elevator locking to the controller.

The elevator moving cylinder (12) extends a small sledge to couple or uncouple the elevator (3, 4). The coupling is confirmed by a hydraulic pressure switch that sends an electrical signal to the controller.

An energy chain (17) is used to move the hydraulic tubes. The hydraulic tubes are moved so small that the durability is enhanced.

Furthermore, FIG. 1 shows a locking pivot (18), a rear multi-coupling (19) and a feedback signal (20). Additionally, a locking cylinder (21).

Additionally, a locking cylinder (21), a locking pin (22) and an oil flow divider (23) are identified.

Other illustrated details are related to transport rollers (24), a safety load hook (25) and an indicating box (26) which provides an Optical feedback signal.

Furthermore, a locking pivot (27) and a threaded coupling (28) are identified.

FIG. 2 shows a side view of the apparatus according to FIG. 1 corresponding to line of sight II in FIG. 1. Hero are identified various hydraulic, pneumatic and electric connecting elements. The element (30) Carries Out the supply of lubricating materials, the element (31) is the opening of the locking cylinder (21), the element (32) the closing of the holding apparatus (3, 4), the element (33) the opening of the holding apparatus (3, 4), the element (34) the closing of the locking cylinder (21), and the element (35) provides the feedback signal. The element (36) conveys the air pressure in order to arrange the sledge (11) in the park position, the element (37) supplies the cleaning air and the element (38) carries out return of the transport: rollers (24) or return of the holding apparatus (3, 4). The element (39) is to supply the pressure to the flow divider for the transport rollers (24) or the pressure for the positioning of the holding apparatus (3, 4). The element (40) serves for return of the cylinder and the element (41) transmits the pressure of the cylinder for SCID-system.

All elements (30-41) illustrated in FIG. 2 can play roles as coupling elements or conductors for arranged hydraulic pneumatic; or electric piping.

Figure 3:
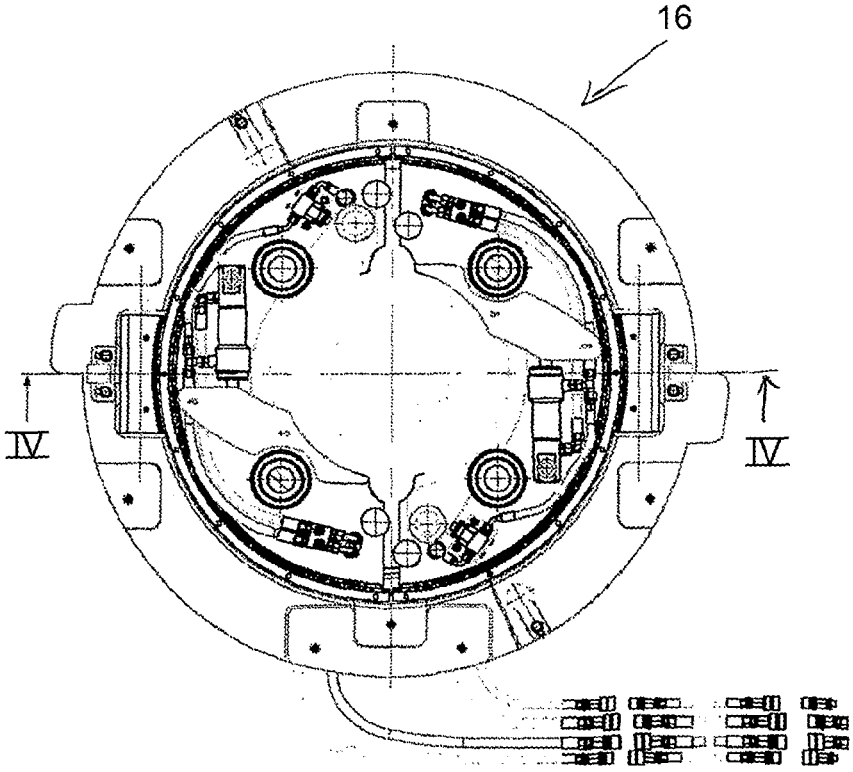
Figure 4:
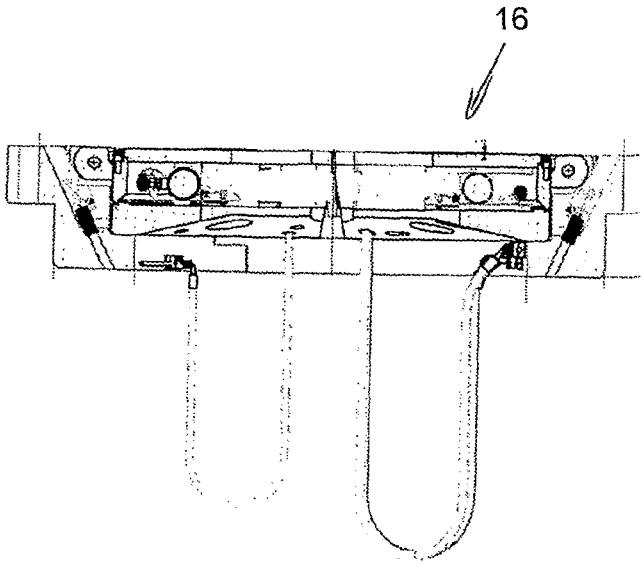

FIG. 3 shows a top view of the centering apparatus (16) and FIG. 4 shows a cross section through the centering apparatus (16) according to intersection line IV-IV in FIG. 3.

Figure 5:
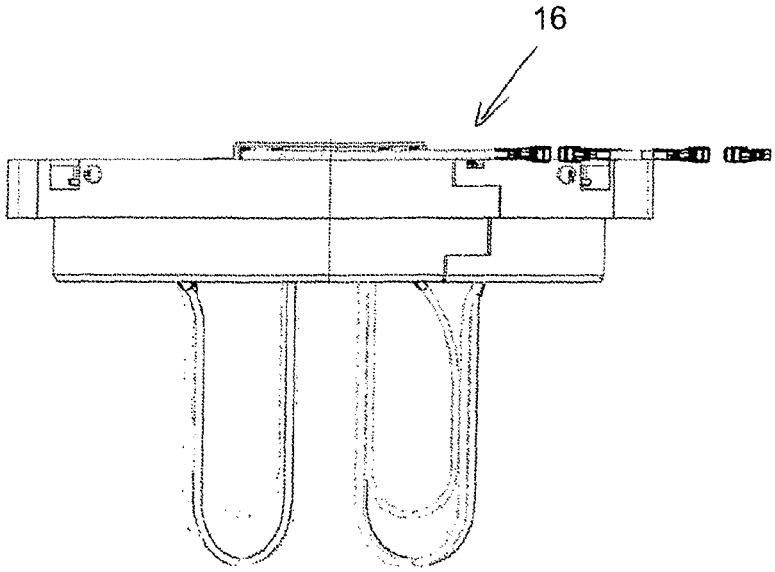
Figure 6:
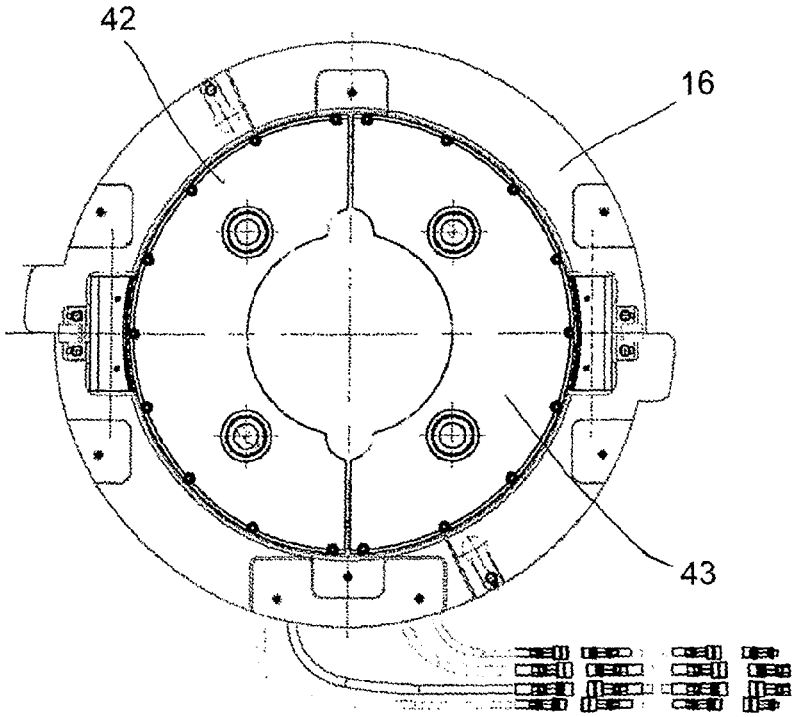
Figure 7:
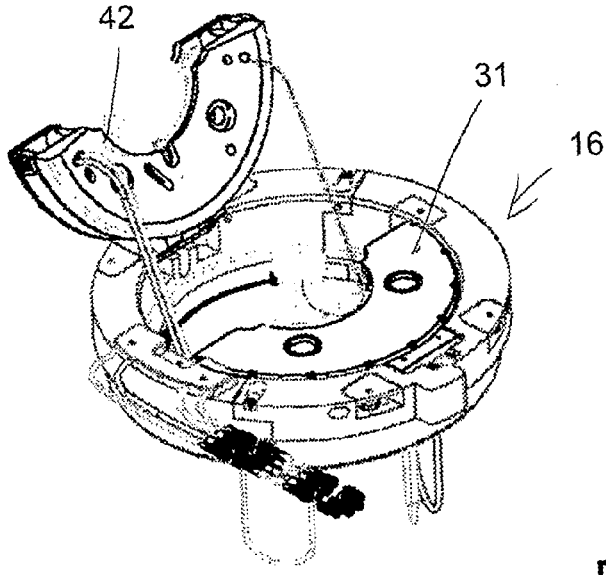

FIG. 5 shows a side view of the centering apparatus (16) and FIG. 6 a top view of the centering apparatus (16) with flaps (42, 43) that are tilted down. FIG. 7 shows a perspective presentation of the centering apparatus (16), by which the flap (42) is tilted up. The flaps (42, 43) configure the centering elements of the centering apparatus (16), which act upon the drill pipe (2).

The invention claimed is:

1. Handling apparatus for pipes, in which a holding apparatus is so arranged as to be positionable both horizontally and vertically and this apparatus is equipped with a controllable clamping apparatus for the pipes, wherein, in the vicinity to the holding apparatus (3), a centering apparatus (16) is arranged for the pipe to be held, wherein the centering apparatus (16) is equipped with flaps (42, 43) that can change their direction as centering elements.

2. Handling apparatus according to claim 1, wherein the centering apparatus (16) is hydraulically configured.

3. Handling apparatus according to claim 1, wherein the centering apparatus (16) is held by a rotary table.

4. Handling apparatus according to claim 1, wherein two holding apparatuses (3, 4) are arranged on a sledge (11) one after the other, in direction of a longitudinal axis of the sledge.

5. Handling apparatus according to claim 4, wherein, at least, one of the holding apparatuses (3, 4) is equipped with a lateral door.

6. Handling apparatus according to claim 4, wherein a proximity switch is used for, at least, one of the holding apparatuses (3, 4).

7. Handling apparatus according to claim 1, wherein the centering apparatus (16) is equipped with guide plates.

8. Handling apparatus according to claim 1, wherein the flaps (42, 43) can be locked in a high-swung location.

9. Handling apparatus according to claim 1, wherein the centering apparatus (16) has a divided outer ring.

10. Handling apparatus according to claim 1, wherein an elevator moving cylinder (12) is provided that is equipped with a hydraulic drive.

11. Handling apparatus for pipes, in which a holding apparatus is so arranged as to be positionable both horizontally and vertically and this apparatus is equipped with a controllable clamping apparatus for the pipes, wherein, in the vicinity to the holding apparatus (3), a centering apparatus (16) is arranged for the pipe to be held, wherein an elevator moving cylinder (12) is provided that is equipped with a position measuring system.

12. Handling apparatus for pipes, in which a holding apparatus is so arranged as to be positionable both horizontally and vertically and this apparatus is equipped with a controllable clamping apparatus for the pipes, wherein, in the vicinity to the holding apparatus (3), a centering apparatus (16) is arranged for the pipe to be held, wherein an elevator moving cylinder (12) is provided that is equipped with a proportional directional valve.

13. Handling apparatus for pipes, in which a holding apparatus is so arranged as to be positionable both horizontally and vertically and this apparatus is equipped with a controllable clamping apparatus for the pipes, wherein, in the vicinity to the holding apparatus (3), a centering apparatus (16) is arranged for the pipe to be held, wherein the holding apparatus is equipped with a pressure switch as indicating apparatus for a locking function.

14. Handling apparatus for pipes, in which a holding apparatus is so arranged as to be positionable both horizontally and vertically and this apparatus is equipped with a controllable clamping apparatus for the pipes, wherein, in the vicinity to the holding apparatus (3), a centering apparatus (16) is arranged for the pipe to be held, wherein, for moving hydraulic tubes, an energy chain (17) is used.

* * * * *

UNITED STATES PATENT AND TRADEMARK OFFICE

CERTIFICATE OF CORRECTION

PATENT NO. : 8,596,344 B2
APPLICATION NO. : 12/863002
DATED : December 3, 2013
INVENTOR(S) : Lutzhöft et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 572 days.

Signed and Sealed this
Twenty-second Day of September, 2015

Michelle K. Lee

Michelle K. Lee
*Director of the United States Patent and Trademark Office*